US005819975A

United States Patent [19]

Pendleton et al.

[11] Patent Number: 5,819,975

[45] **Date of Patent: *Oct. 13, 1998**

[54] DISPENSER SUMP

[75] Inventors: David Pendleton, Fairfield; James Kesterman, Cincinnati, both of Ohio

[73] Assignee: Dover Corp., New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 728,257

[22] Filed: Oct. 8, 1996

[51] Int. Cl.[6] ..... B65D 88/76

[52] U.S. Cl. ..... 220/484; 220/608; 220/571; 405/52; 405/55

[58] Field of Search ..... 405/52, 53, 39, 405/54, 55; 220/608, 571, DIG. 6, 484

[56] References Cited

U.S. PATENT DOCUMENTS

| | | | |
|---|---|---|---|
| D. 309,308 | 7/1990 | Webb . | |
| D. 313,418 | 1/1991 | Webb . | |
| D. 322,970 | 1/1992 | Webb . | |
| 1,161,727 | 11/1915 | Randall | 220/571 |
| 3,405,858 | 10/1968 | Collie | 220/608 |
| 3,884,383 | 5/1975 | Burch et al. | 220/608 |
| 4,457,349 | 7/1984 | Vazin . | |
| 4,663,036 | 5/1987 | Strobl, Jr. et al. | 405/52 |
| 4,793,387 | 12/1988 | LeBlanc et al. . | |
| 4,805,444 | 2/1989 | Webb . | |
| 4,932,257 | 6/1990 | Webb . | |
| 4,971,225 | 11/1990 | Bravo . | |
| 4,971,477 | 11/1990 | Webb et al. . | |
| 5,040,408 | 8/1991 | Webb . | |
| 5,058,774 | 10/1991 | Hartman et al. . | |
| 5,060,509 | 10/1991 | Webb . | |
| 5,098,221 | 3/1992 | Osborne . | |
| 5,160,064 | 11/1992 | LeBlanc . | |
| 5,201,151 | 4/1993 | LeBlanc et al. . | |
| 5,257,652 | 11/1993 | Lawrence . | |
| 5,263,794 | 11/1993 | Webb . | |
| 5,271,518 | 12/1993 | Webb . | |
| 5,297,896 | 3/1994 | Webb . | |
| 5,333,490 | 8/1994 | Webb . | |
| 5,346,625 | 9/1994 | Webb . | |
| 5,366,318 | 11/1994 | Brancher . | |
| 5,372,454 | 12/1994 | Lawrence . | |
| 5,392,945 | 2/1995 | Syrek | 220/608 |
| 5,398,976 | 3/1995 | Webb . | |
| 5,407,300 | 4/1995 | Guindon et al. . | |
| 5,423,447 | 6/1995 | Youngs . | |
| 5,490,419 | 2/1996 | Webb . | |
| 5,494,374 | 2/1996 | Youngs et al. . | |
| 5,501,243 | 3/1996 | Palazzo . | |
| 5,527,130 | 6/1996 | Webb . | |
| 5,553,971 | 9/1996 | Osborne . | |
| 5,567,083 | 10/1996 | Osborne . | |
| 5,615,798 | 4/1997 | Luburic et al. | 220/608 |
| B1 5,040,408 | 8/1991 | Webb . | |
| B1 5,060,509 | 9/1994 | Webb . | |
| B1 5,263,794 | 1/1996 | Webb . | |

FOREIGN PATENT DOCUMENTS 9320372 10/1993 WIPO .

OTHER PUBLICATIONS

Advanced Polymer Technology, Inc., QUICK–SET™ *Modular Tank Sump System,* Pub. TS201, various pages Aug. 01, 1993, Elkhart, IN.

Environ, Tank Sump Manual, Publication PM–0104, Issue Date Jul. 1, 1994, various pages Environ Products, Inc., Lionville, PA.

(List continued on next page.)

*Primary Examiner*—Stephen J. Castellano
*Attorney, Agent, or Firm*—Dinsmore & Shohl LLP

[57] ABSTRACT

A dispenser sump which includes a deflection surface and a distribution channel for distributing liquids about the interior periphery of the sump to allow insertion of fluid removal apparatus along any wall of the sump. The sump also provides increased structural rigidity to support backfill surrounding the sump and to maintain shape integrity.

14 Claims, 3 Drawing Sheets

OTHER PUBLICATIONS

Total Containment Inc., *Dispenser Sumps,* Publ No., DS800, Sep. 1, 1994, various pages, Oaks, PA.

Environ, GeoFlex™ Piping System, Pub. PM–0402, Feb. 1, 1994, various pages, Environ Products, Inc., Lionville, PA.

Total Containment Inc., US Price Manual, Pub. PM1500, Apr. 1, 1995, various pages, Oaks, PA.

Total Containment, Inc. Tank Sumps: *Fiberglass/Cuffed Polyethylene,* Pub. SR300, Jun. 1, 1995, various pages, Oaks, PA.

Advanced Polymer Technology, Inc., *Poly–Tech TS–4230 Standard Burial Tank Sump,* Pub. TS42, Sep. 15, 1995, various pages, Elkhart, IN.

Advanced Polymer Technology, Inc., Poly–Tech, Advanced Flexible Underground Piping System, Form 4–95–5M, 1995, various pages, Elkhart, IN.

Total Containment, Inc., Delivering the Difference, 1996, various pages, Oaks, PA.

Advanced Polymer Technology, Inc., Poly–Tech WC–4236 Watertight Design Lid Kit, Pub. WC–4236, Feb. 1, 1996, various pages, Elkhart, IN.

Advanced Polymer Technology, Inc., Poly–Tech Large Mouth Modular Dispenser Sump, Pub. LM201, Apr. 1, 1996, various pages, Elkhart, IN.

Total Containment Inc., Pioneering Secondary Containment Systems for Future Generations, PB100, 4.95, various pages, Oaks, PA.

Environ Products Inc., Product Price List, Pub. P–APB–1010, Aug. 15, 1996, Lionville, PA.

Environ Products, Inc., The GeoFlex System, Pub., P–APB–2010, Oct. 1, 1996, various pages, Lionville, PA.

DISPENSER SUMP

TECHNICAL FIELD

The present invention relates generally to dispenser sumps used in gasoline stations and the like, and is particularly directed to a dispenser sump having a sump bottom including a deflection surface and a peripheral distribution channel for distributing a fluid, such as gasoline, about the periphery of the sump bottom.

BACKGROUND OF THE INVENTION

Gasoline service stations include an underground fueling network of dispenser sumps, fuel conduits and entry fittings. Dispenser sumps are used to contain leaked fluids, such as gasoline, which can leak from a fitting housed in the sump, or a fuel dispenser positioned above the sump. Such leakage can occur, for example, because of a seal or conduit rupture, or during routine maintenance of the fuel dispenser, such as during replacement of the fuel dispenser's filter. Containment of such leakage prevents gasoline from entering the ground and passing into the ground water. After leakage has occurred, a liquid removal apparatus is inserted into the sump to remove the liquid from the bottom of the sump.

During the installation of the underground fueling network, the site is excavated, the fuel conduits, entry fittings and dispenser sumps are properly positioned and interconnected, and backfill is loaded back into the hole to support the asphalt layer which will be poured above the network. Even after installation, individuals enter the sump to maintain fuel conduits and entry fittings, and thus the sump must be sufficiently rigid to maintain shape integrity despite the backfill surrounding the sump.

A conventional sump has a generally flat bottom which causes leakage to spread relatively evenly across the sump bottom. One problem with such conventional sump bottoms is that the apparatus used to remove leakage from the sump must have access to the entire bottom surface to ensure removal of all the gasoline. However, access to the entire bottom surface may be difficult due to the fittings and conduits within the sump, and the internal mechanism of the fuel dispenser above the sump.

U.S. Pat. Nos. 4,842,163 and 4,971,225 disclose a sump bottom having a slanted bottom surface which accumulates leaked gasoline along one edge of the sump bottom, to allow the installation of leakage detection apparatus along that edge of the sump bottom. The '163 and '225 patents also disclose a closed-loop fuel recovery system including a drain along the accumulation edge of the sump bottom. The sump disclosed in the '163 and '225 patents requires access along one particular edge of the sump bottom in order to install such leak detection apparatus and fuel recovery system. As mentioned previously, one may not have unhindered access to a particular edge of the sump bottom due to the fittings and conduits within the sump, and the internal mechanism of the fuel dispenser above the sump.

It is apparent that a sump dispenser which enables removal of fuel from any location about the periphery of the sump bottom and thus enables access by leakage removal apparatus along any wall of the sump, and which increases structural rigidity of the sump would be desirable.

SUMMARY OF THE INVENTION

It is one object of this invention to provide a sump which allows removal of leaked fuel contained by the sump from any location about the periphery of the sump bottom.

It is another object of this invention to provide a sump having a sump bottom which increases the structural rigidity of the sump bottom.

Additional objects, advantages and other novel features of the invention will be set forth in part in the description that follows and, in part, will become apparent to those skilled in the art upon examination of the invention. The objects and advantages of the invention may be realized and obtained by means of the instrumentalities and combinations particularly pointed out in the appended claims.

To achieve the foregoing and other objects and in accordance with the purposes of the present invention as described above, a sump is provided which includes a side wall, a bottom including a deflection surface and a peripheral distribution channel. The side wall extends upwardly with respect to the bottom. The distribution channel has a channel bottom for distributing fluid along the channel, and preferably circumscribes the deflection surface. The deflection surface has a base portion and an apex portion, the base portion being positioned adjacent the opening of the channel, and the deflection surface sloping from the base portion to the apex portion. The apex portion of the deflection surface is positioned at a higher elevation than the base portion. The deflection surface is operative to deflect a liquid impinging the deflection surface to the distribution channel for distribution of the liquid within the distribution channel.

According to one embodiment of this invention, the deflection surface includes four generally planar panels, each panel having a base end, an apex end, and two side edges which converge with respect to each other toward the apex end. Each base end of each panel is positioned adjacent the distribution channel. The apex end of each panel abuts an apex end of an adjacent panel, and the apex ends of the generally planar panels are at a higher elevation than their base ends. According to a preferred embodiment of this invention, the deflection surface has a pyramidal shape, with the base of the pyramid positioned adjacent the distribution channel, and the apex of the pyramid being at a higher elevation than the base of the pyramid.

The deflection surface deflects liquids contacting the surface, such as gasoline leaking from the fitting housed within the sump or the fuel dispenser positioned above the sump, and deflects the liquid into the distribution channel. The distribution channel spreads the liquid about the periphery of the sump bottom. Such distribution of the fuel along the entire periphery of the bottom enables fuel removal apparatus to be inserted into the sump along any wall of the sump, eliminating the concern that fittings, conduits, or other obstructions may inhibit fuel removal from the sump.

The deflection surface also provides increased structural rigidity to the dispenser sump, which helps maintain the shape integrity of the sump. Such increased structural rigidity decreases the probability that the sump will inwardly collapse with the additional weight of an individual in the sump maintaining the sump fittings.

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different obvious aspects all without departing from the invention. Accordingly, the drawings and description will be regarding as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to the present preferred embodiment of the invention, an example of which is illustrated in the accompanying drawings, wherein like numerals indicate the same elements throughout the views.

DETAILED DESCRIPTION OF PREFERRED EMBODIMENTS

Figure 1:
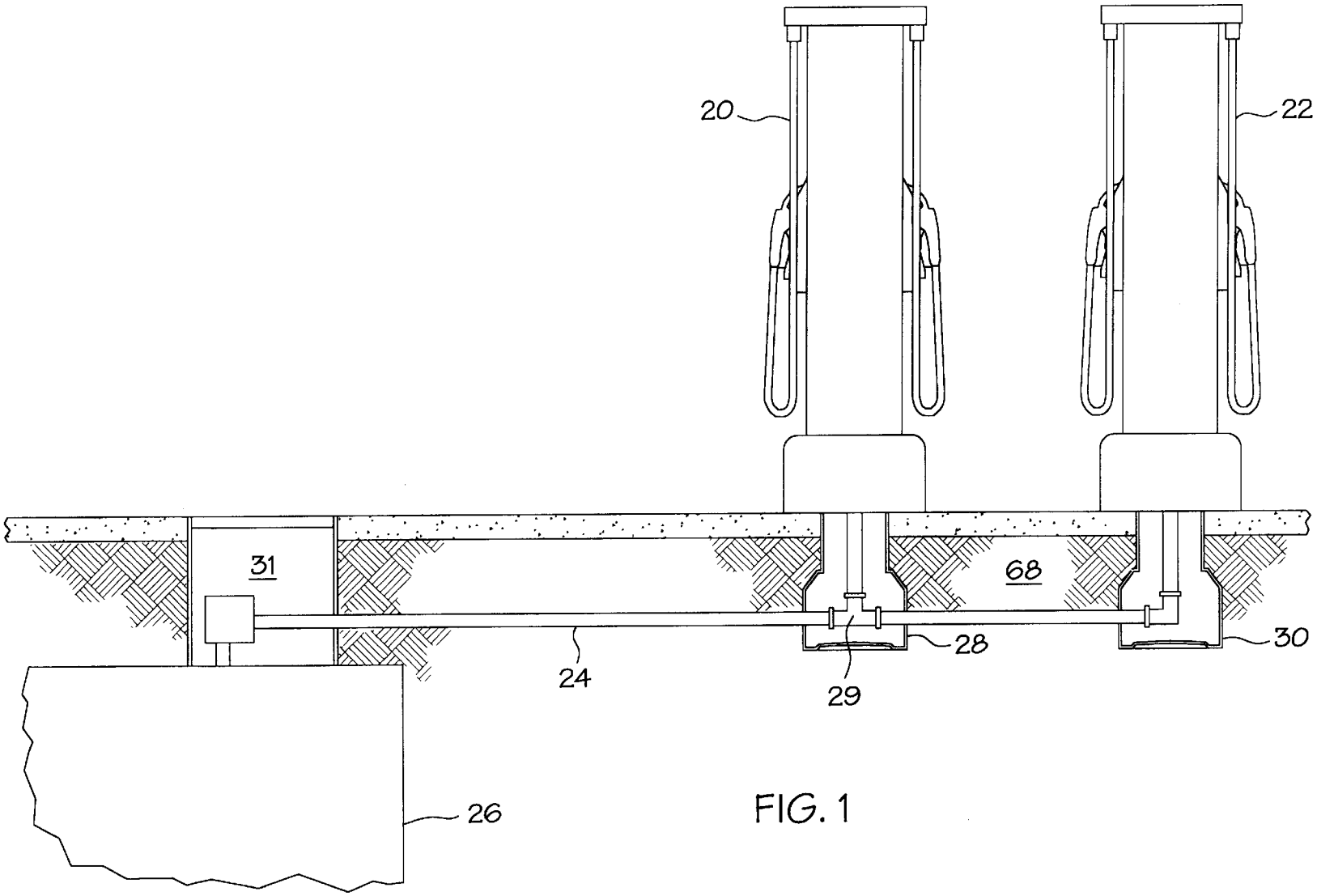
FIG. 1 is a plan view of a fuel dispensing system showing a dispenser sump according to one embodiment of this invention.

Referring now to the drawings, FIG. 1 is a plan view of an underground gas distribution system using a sump according to one embodiment of this invention. Upon demand from fuel dispenser 20, fuel, such as gasoline, is pumped from underground fuel tank 26 through fuel conduit 24 to fuel dispenser 20. Underground fuel tank 26 can be replenished via access space 31. Sump 28 is positioned under fuel dispenser 20 and can contain gasoline which may leak from fuel dispenser 20. Sump 28 also houses fitting 29, and can similarly contain any leakage from fitting 29. Backfill 68 surrounds the exterior of sump 28.

Sump 28 must be rigid enough to withstand the impact of backfill 68 when initially loaded about sump 28, as well as the continuous pressure exerted by the mass of backfill 68. Leaked gasoline contained by sump 28 can be removed by inserting fuel removal apparatus through an access door in fuel dispenser 20, not shown, and into sump 28.

Figure 2:
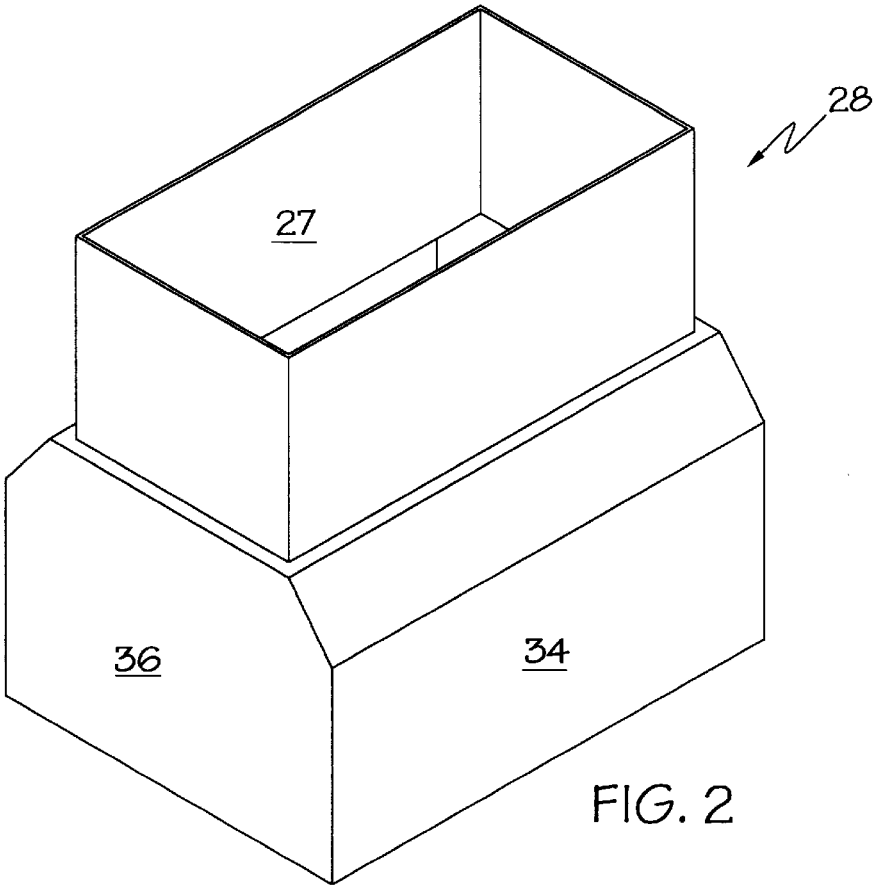
FIG. 2 is a perspective view of a sump according to one embodiment of this invention.

FIG. 2 shows sump 28 according to one embodiment of this invention. Sump 28 includes mouth 27 which is positioned concentric with fuel dispenser 20. Sump 28 has side walls 36 and 34.

Figure 3:
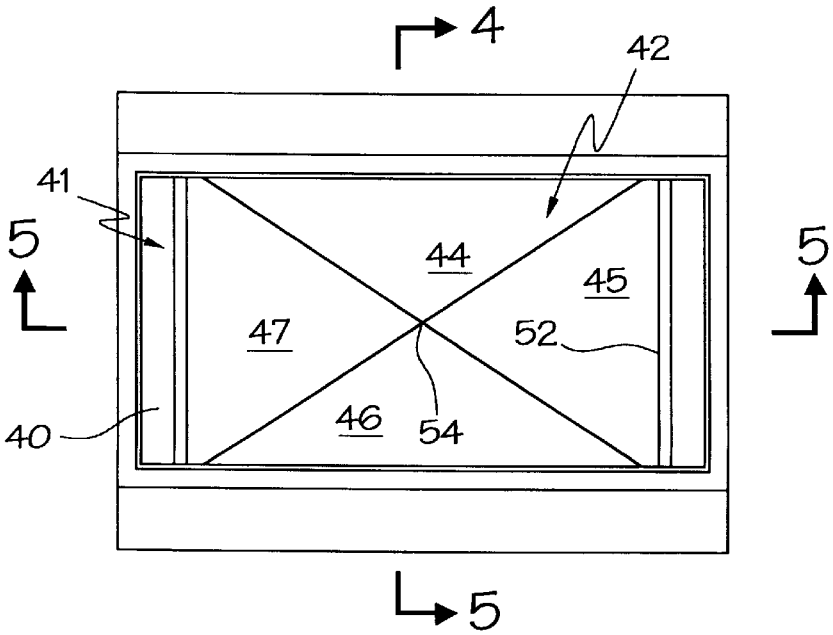
FIG. 3 is a top view of the sump shown in FIG. 2.

FIG. 3 shows a top view of sump 28 as shown in FIG. 2. Bottom 41 includes deflection surface 42 and distribution channel 40. Deflection surface 42 can include panels 44, 45, 46 and 47. Each of panels 44–47 can have a base end, such as base end 52 of panel 45, and each panel can have an apex end, such as apex end 54 of panel 45. The apex end of each panel preferably abuts an apex end of an adjacent panel. The base portion of each panel is positioned adjacent distribution channel 40. Bevel portion 50 can separate deflection surface 42 from distribution channel 40, although it is apparent that base end 52 could abut the mouth of distribution channel 40, eliminating bevel portion 50. Liquid impinging upon deflection surface 42 is deflected to distribution channel 50 where it spreads out along the channel about the periphery of the sump bottom. Distribution channel 50 is preferably a closed path and entirely circumscribes deflection surface 42.

Figure 4:
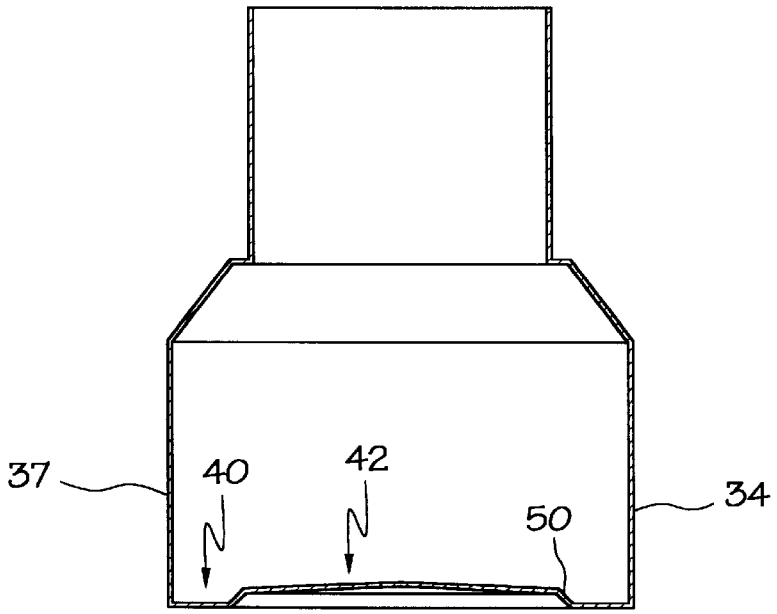
FIG. 4 is a cross-sectional view of the sump shown in FIG. 3 taken along line 4—4 of FIG. 3.

FIG. 4 is a cross-sectional view of sump 28 taken along line 4—4 of FIG. 3. As more clearly seen in FIG. 4, deflection surface 42 deflects a liquid impinging upon deflection surface 42 to distribution channel 40. Distribution channel 40 distributes the liquid within distribution channel 40 about the periphery of bottom 41. Although sump 28 is shown as including four generally planar panels 44–47, it is apparent that deflection surface 42 can have more than four generally planar panels, and that deflection surface 42 can comprise shapes that do not require planar panels, such as a conical or frusto-conical shapes, so long as the shape is suitable for deflecting impinging liquids to distribution channel 40. According to one embodiment of this invention, each of side walls 34, 35, 36 and 37 form one side of distribution channel 40, as shown in FIG. 4.

Figure 5:
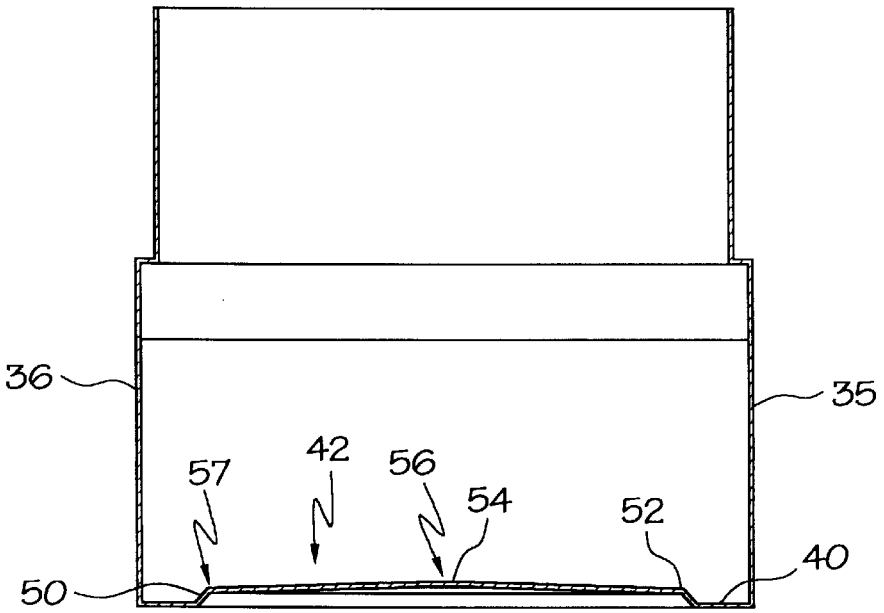
FIG. 5 is a cross-sectional view of the sump shown in FIG. 3 taken along line 5—5 of FIG. 3.

FIG. 5 is a cross-sectional view of sump 28 as shown in FIG. 3, taken along line 5—5 of FIG. 3. Base end 52 is positioned adjacent distribution channel 40. Apex end 54 terminates at apex portion 56. Sump 28 according to this invention deflects liquid impinging deflection surface 42 into distribution channel 40 which distributes the liquid about the periphery of bottom 41. Sump 28 allows installation of leakage removal apparatus along any wall having unhindered access to distribution channel 40, for complete removal of leaked fuel within sump 28. Sump 28 according to this invention achieves a marked improvement over conventional sumps, since the internal mechanism of the fuel dispenser located above sump 28, and fitting 29 and fuel conduit 24 housed within sump 28 can prevent access to portions of sump bottom 41, resulting in only partial cleanup of leaked fuel. Bottom 41, which includes apex portion 56 being at a higher elevation than base portion 57, improves structural rigidity to maintain shape integrity despite the pressure of backfill 68 surrounding side walls 34–37.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention and various embodiments and with various modifications as are suited to the particular use contemplated. It is intended that the scope of the invention be defined by the claims appended hereto.

What is claimed is:

1. A filling station island, comprising:

a) a top surface;

b) a fuel dispenser mounted on the top surface;

c) a sump for distributing a liquid about the interior periphery of the sump, said sump being located substantially below the top surface and under the fuel dispenser, said sump comprising (i) a rigid enclosure;

(ii) a rigid bottom closing off an end of the enclosure;

(iii) the bottom having a distribution channel and an interior deflection structure, the distribution channel circumscribing a base portion of the deflection structure, the deflection structure having an apex, and a surface slanted with respect to enclosure, the apex at a higher elevation than the base portion.

2. A filling station island as recited in claim 1, wherein the enclosure comprises four side walls joined in a rectangular configuration.

3. A filling station island as recited in claim 1, wherein a bottom portion of the enclosure forms one side of the distribution channel.

4. A filling station island as recited in claim 1, wherein the deflection surface comprises a plurality of generally planar panels, each panel has a base end, an apex end, and two side edges which converge with respect to each other toward the apex end, each base end is positioned adjacent the distribution channel, each apex end is positioned adjacent an apex end of an adjacent panel, and the apex ends of the generally planar panels are at a higher elevation than the base ends of the generally planar panels.

5. A filling station island as recited in claim 1, wherein the deflection surface comprises a pyramidal shape, the base of the pyramid is positioned adjacent the distribution channel, and the apex of the pyramid is at a higher elevation than the base of the pyramid.

6. A filling station island as recited in claim 1, wherein the apex portion of the deflection surface comprises a generally planar section having a relatively small surface area with respect to the remainder of the deflection surface, and the edge of the apex portion transitions into a surface which slants toward the base portion of the deflection surface.

7. A filling station island as recited in claim 1, wherein the distribution channel is a closed path.

8. A filling station island, comprising:

a) a top surface;

b) a fuel dispenser mounted on the top surface;

c) a sump for containing fluids located substantially below the top surface and under the fuel dispenser, said sump comprising (i) at least one rigid side wall;

(ii) a rigid bottom including a deflection surface and a peripheral distribution channel, the at least one side wall extending upwardly with respect to the bottom;

(iii) the peripheral distribution channel having a channel bottom for distributing fluid within the channel; and (iv) the deflection surface having a base portion and an apex portion, the base portion being positioned adjacent an opening of the channel, the deflection surface sloping from the base portion to the apex portion, and the apex portion positioned at a higher elevation than the base portion, whereby the deflection surface is operative to deflect a liquid impinging the deflection surface to the distribution channel for distribution of the liquid within the channel.

9. A filling station island as recited in claim 8, wherein the at least one side wall comprises four side walls joined in a rectangular configuration.

10. A filling station island as recited in claim 8, wherein a bottom portion of the at least one side wall forms one side of the distribution channel.

11. A filling station island as recited in claim 8, wherein the deflection surface comprises a plurality of generally planar panels, each panel has a base end, an apex end, and two side edges which converge with respect to each other toward the apex end, each base end is positioned adjacent the distribution channel, each apex end is positioned adjacent an apex end of an adjacent panel, and the apex ends of the generally planar panels are at a higher elevation than the base ends of the generally planar panels.

12. A filling station island as recited in claim 8, wherein the deflection surface comprises a pyramidal shape, the base of the pyramid is positioned adjacent the distribution channel, and the apex of the pyramid is at a higher elevation than the base of the pyramid.

13. A filling station island as recited in claim 8, wherein the apex portion of the deflection surface comprises a generally planar section having a relatively small surface area with respect to the remainder of the deflection surface, and the edge of the apex portion transitions into a surface which slopes toward the base portion of the deflection surface.

14. A filling station island as recited in claim 8, wherein the distribution channel is a closed path.

* * * * *